US005443549A

United States Patent [19]

Mimuro et al.

[11] Patent Number: 5,443,549

[45] Date of Patent: Aug. 22, 1995

[54] TERMINAL CRIMPING MACHINE

[75] Inventors: Shuji Mimuro; Kazuhiko Takada; Mitsugu Iwata, all of Shizuoka, Japan

[73] Assignee: Yazaki Corporation, Tokyo, Japan

[21] Appl. No.: 253,920

[22] Filed: Jun. 3, 1994

[30] Foreign Application Priority Data

Jun. 15, 1993 [JP] Japan ..... 5-143653

[51] Int. Cl.[6] ..... H01R 43/04; B21J 13/02

[52] U.S. Cl. ..... 72/482; 72/441; 72/7; 72/31; 29/753

[58] Field of Search ..... 72/7, 31, 441, 482; 29/715, 753

[56] References Cited

U.S. PATENT DOCUMENTS

| | | | |
|---|---|---|---|
| 3,948,077 | 4/1976 | Bothe | 72/441 |
| 4,283,929 | 8/1981 | Heiberger | 72/7 |
| 4,587,725 | 5/1986 | Ogawa et al. | 72/441 |
| 4,970,889 | 11/1990 | Phillips et al. | 72/441 |
| 5,175,925 | 1/1993 | Grosklos et al. | 72/441 |
| 5,323,634 | 6/1994 | Wolfe et al. | 72/441 |
| 5,337,589 | 8/1994 | Gloe et al. | 72/441 |

FOREIGN PATENT DOCUMENTS

| | | | |
|---|---|---|---|
| 61-71577 | 4/1986 | Japan . | |
| 0099730 | 4/1991 | Japan | 72/31 |

*Primary Examiner*—David Jones

*Attorney, Agent, or Firm*—Armstrong, Westerman, Hattori, McLeland & Naughton

[57] ABSTRACT

A terminal crimping machine provided with an applicator having a crimper for crimping a terminal to a wire and an anvil, comprising: a frame; a cylinder fixed to said frame and having a rod, said cylinder for moving the crimper up and down and; a bumping member fixed on the rod of said cylinder; a height adjusting plate having a gradually changing height provided on said frame oppositely to said bumping member; and driving means for sliding said height adjusting plate in a direction orthogonal to said rod. Thus, the terminal machine can automatically adjust the crimping height of a terminal in accordance with its kind.

5 Claims, 10 Drawing Sheets

TERMINAL CRIMPING MACHINE

BACKGROUND OF THE INVENTION

1. Field of the Invention

The present invention relates to a terminal crimping machine which can automatically adjust the crimping heights in accordance with several kinds of terminals.

2. Description of the Prior Art

FIG. 10 shows the prior art terminal crimping machine described in JP-A (Laid-Open) Sho 61-71577.

As shown in FIG. 10, in a terminal crimping machine 40, a toggle link 44 is coupled, through a clank 43, with a flywheel 42 provided within a frame 42; at the lower end of the link 44, a crimper 47 for an anvil (crimping jig) 46 on the flame is fixed; at the upper end of the link 44, pins 49 are provided through a fulcrum block 48, the pins 49 being freely slidable and penetrating through the frame 41; a lower wedge 50 coupled with the pin 49 and an upper wedge 51 opposite to the lower wedge 50 are provided; and a motor 52 and a gear 53 for driving the upper wedge 51 are provided.

In operation, the toggle link 44 is driven by rotation of the flywheel 42 so that the slide block 45 ascends or descends to crimp a terminal 54 between the anvil 46 and crimper 47. In this case, the crimping height h of the terminal is adjusted in such a manner that the wedge 51 is horizontally shifted to move the fulcrum block 48 up and down.

However, the above crimping machine 40 has disadvantages that the means (flywheel 42, toggle ling 44, etc. ) for driving is large-scaled and complicate, the large-scale frame 48 having high rigidity is required to use the toggle link 44 and a change in the position of the fulcrum 48 by height adjustment results in a change in the crimping capability.

SUMMARY OF THE INVENTION

An object of the present invention is to provide a terminal crimping machine which has so simple a driving mechanism that the machine is made compact, can easily the height of crimping and has crimping capability which is not dependent on adjustment of the height of crimping.

In order to attain the above object, there is provided a terminal crimping machine provided with an applicator having a crimper for crimping a terminal to a wire and an anvil, comprising a first structure composed of a a frame; a cylinder fixed to said frame and having a rod, said cylinder for moving the crimper up and down; a bumping member fixed on the rod of said cylinder; a height adjusting plate having a gradually changing height provided on said frame oppositely to said bumping member; and driving means for sliding said height adjusting plate in a direction orthogonal to said rod, or otherwise a second structure composed of a frame; a frame stand on which said anvil is fixed and which can rise or fall for said frame; and a driving device for moving the frame stand up and down.

Preferably, the terminal crimping machine includes a discrimination sensor for discriminating the kind of said applicator; and a control device connected between said discrimination sensor and said driving device for storing crimping heights for said applicator.

In operation, the terminals are crimped in such a manner that an upper crimper is directly moved up and down by a power cylinder. The crimping height is adjusted in the first structure by collision or mating of a bumping member and a height adjusting plate which directly defines the protruding length of the rod of said cylinder which is a driving means, and adjusted in the second structure in which the frame stand to which the lower anvil is fixed is moved up and down.

The discrimination sensor senses the color and shape of the applicator to send a signal to the control device in accordance with the kind of the applicator, and the control device drives the driving device so as to provide a predetermined crimping height according to the applicator.

In accordance with the present invention, the upper crimper is directly moved up and down by the cylinder to crimp a terminal, and also the crimping height is adjusted by direct provision of the upper crimper on the rod of the cylinder or rise/fall of the lower crimper by the driving device. The crimping machine itself becomes more simple and compact than the prior art complicate and large-scale mechanism provided with a link. Since the pressing force of the cylinder is constant, even when the protruding length of the rod is directly defined to adjust the crimping height, the crimping capability is not changed to provide always stabilized crimping quality. Further, since the discrimination sensor and control device can automatically adjust the crimping height according to each kind of applicator, the adjustment time can be shortened and production efficiency can be enhanced.

The above and other objects and features of the present invention will be more apparent from the following description taken in conjunction with the accompanying drawings.

DESCRIPTION OF THE PREFERRED EMBODIMENTS

Embodiment 1

Figure 1:
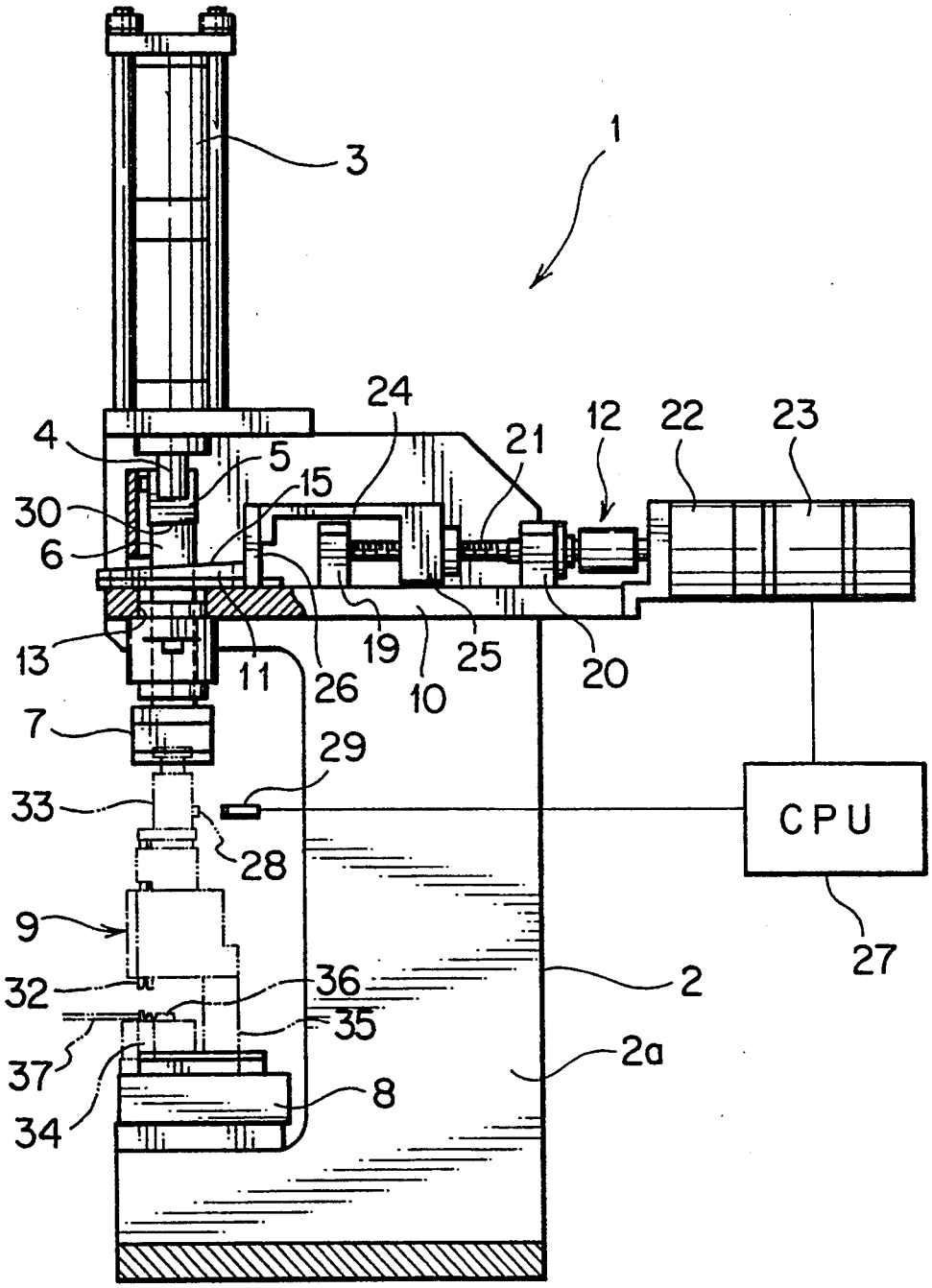
FIG. 1 is a partially-cut side view of one embodiment of the terminal crimping machine according to the present invention.
Figure 2:
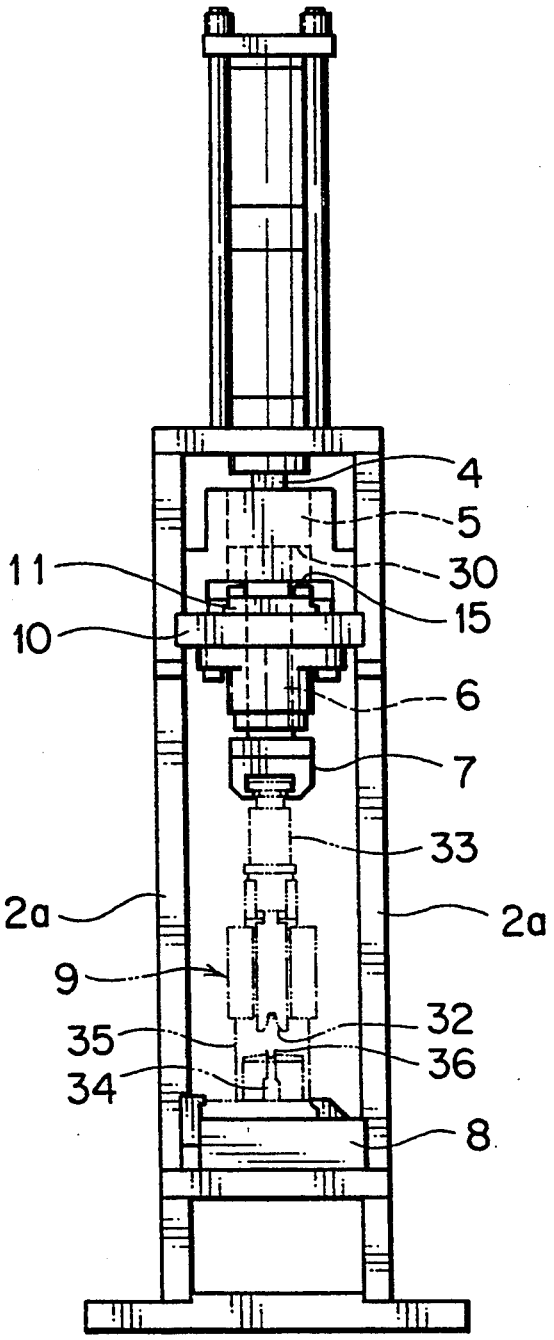
FIG. 2 is a front view of the one embodiment in FIG. 1.

FIG. 1 is a side view showing the first embodiment of the terminal crimping machine according to the present invention and FIG. 2 is a front view of the terminal crimping machine in FIG. 1.

As shown in FIG. 1, a terminal crimping machine 1 is composed of a pneumatic-hydraulic type power cylinder 3 fixed so as to be upside down above a frame 2 having a ] shape, a bumping member 5 fixed on the tip of the rod of the cylinder 3 through a bolt, a sliding shaft 6 formed integrally to the bumping member 5 and extended downward, a junk holder fixed to the tip of the sliding shaft 6, an applicator 9 mounted between the junk holder 7 and a frame stand 8, a crimping height adjusting plate 10 fixed, in opposition to the bumping member 5, on a horizontal substrate 10 fixed on the intermediate portion of the frame 2, and a driving device 12 for horizontally driving the height adjusting plate 11.

As shown in FIG. 2, within the frame 2 a pair of side walls 2*a* and 2*a* opposite to each other are provided, the above horizontal substrate 10 is arranged between the side walls 2*a* and 2*a*, and the sliding shaft 6 is penetrated through a though-hole 13 provided on the substrate 10. As seen from the enlarged views of FIGS. 3 and 4, and the perspective view of FIG. 5, the height adjusting member 11 on the horizontal substrate 10 has a long opening 14 for penetration for the sliding shaft 6 at its center and a pair of upward tapered faces 15 and 15 on both sides of the long opening. Each tapered face 15 has a height which increases linearly gradually from the tip to the stem portion of the adjusting plate 11.

The height adjusting plate 11 is slidably engaged between a pair of guide members 16 and 16 arranged on the horizontal substrate 10. Each .guiding members 16 has a groove 18 to be engaged with the side protruding strip 17 of a height adjusting plate 11. On the horizontal substrate 10, the driving mechanism is provided which, as shown in FIG. 1, includes a pair of front and rear bearings 19 and 20 behind the guiding member 16, a ball screw 21 rotatably provided between the bearings 19 and 20, a decelerator 22 and servo motor 23 coupled coaxially to the ball screw 21. The ball screw 21 is screwed with the boss portion of a coupling arm 24 and the wall plate 26 of the front end of the coupling arm is coupled with the base of the height adjusting plate 11.

In operation, the servo motor 23 automatically moves the height adjusting plate 11 to a predetermined position on the basis of the relationship between the crimping height of each kind of terminal previously stored in the control device 27 and the sliding amount of the adjusting plate 11. The control device 27, which is connected to the sensor 29 provided oppositely to the discrimination protrusion 28 of each kind of applicator, drives the servo motor 23 so that the crimping height according to each applicator 9 is automatically obtained from the signal from the sensor 29. The sensor 29 senses the color or shape of the discrimination protrusion 28 to discriminate the kind of the applicator 9.

The bumping member 5 which is located above and oppositely to the height adjusting plate 11 is formed in a square block shape, and, on both sides, has downward tapered slopes 30, 30 with equal angles opposite to the upward tapered slopes of the height adjusting plate 11. On both sides of the bumping member 5, a detent wall 31 for preventing the bumping member 5 from rotating is fixed to the frame 2.

Figure 3:
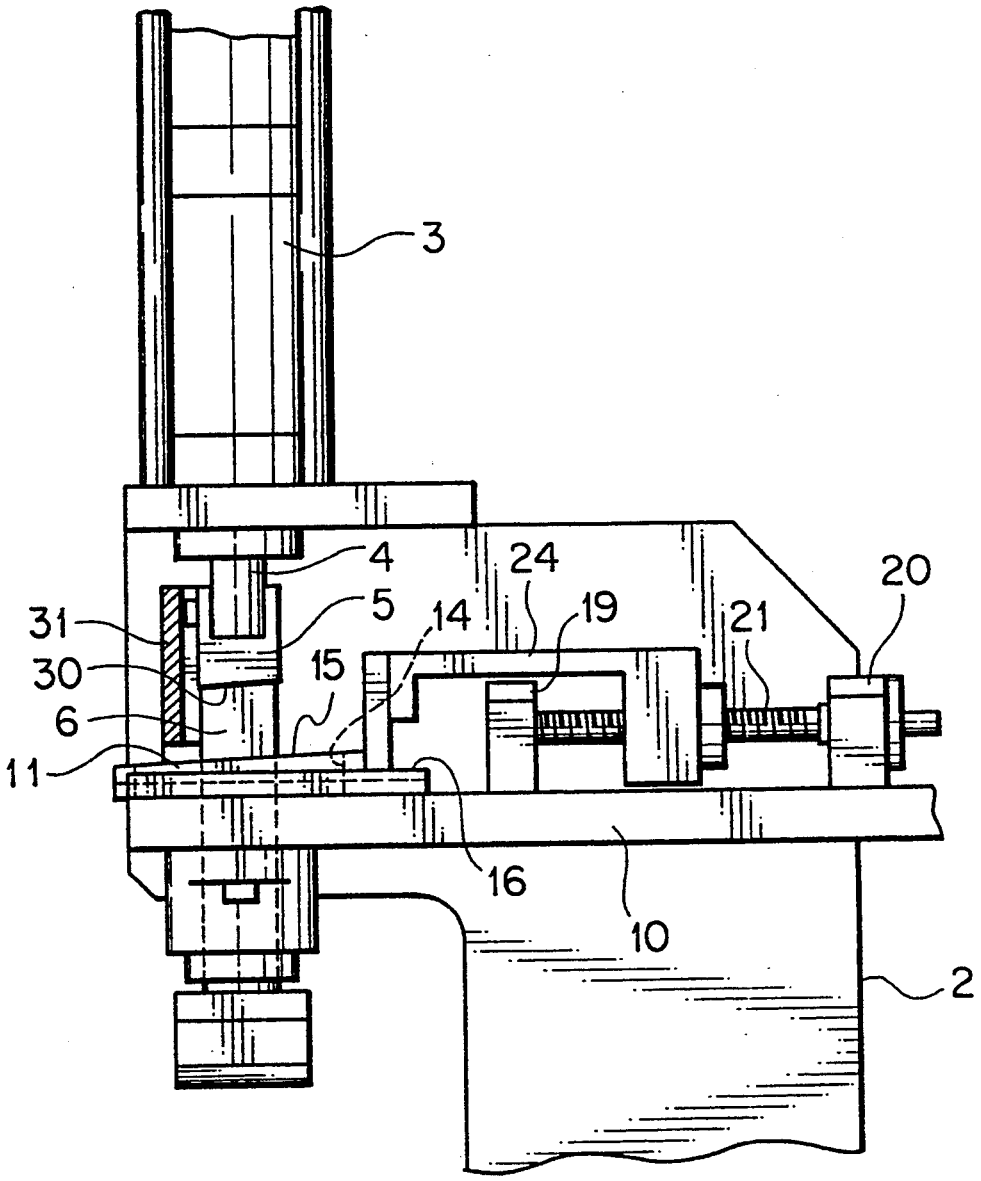
FIG. 3 is a main-part-enlarged side view with at the upper dead point of the crimping machine in the embodiment in FIG. 1.
Figure 4:
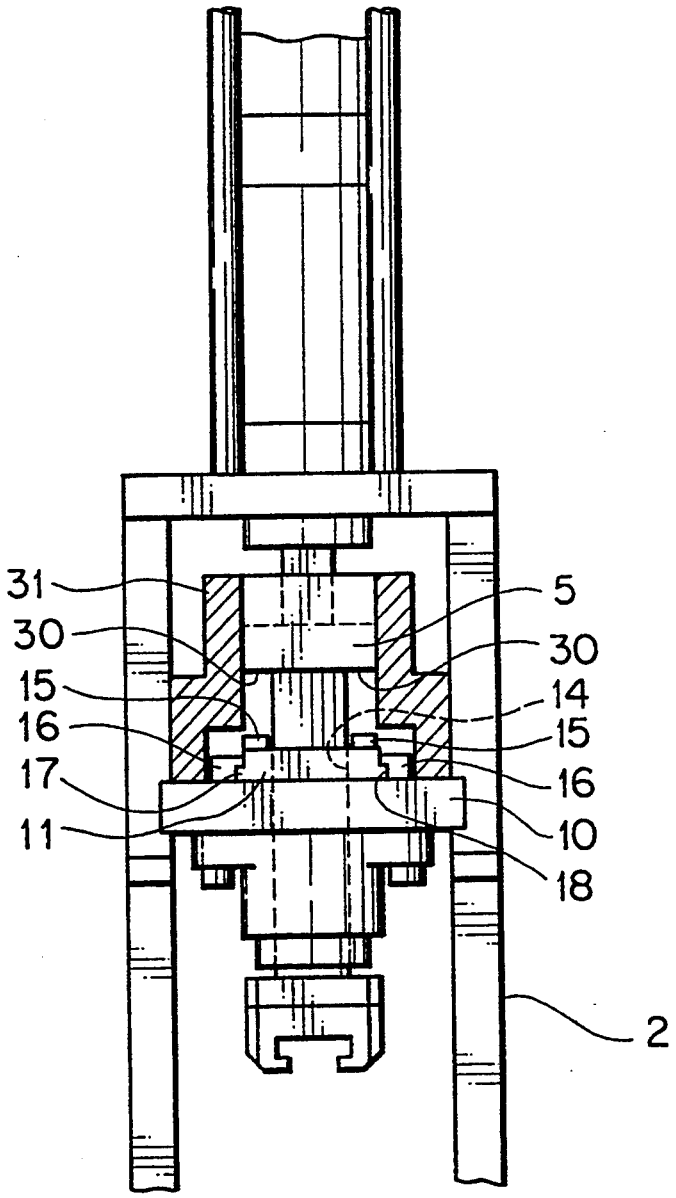
FIG. 4 is a main-part-enlarged front view with at the upper dead point of the crimping machine in the embodiment of FIG. 1.
Figure 5:
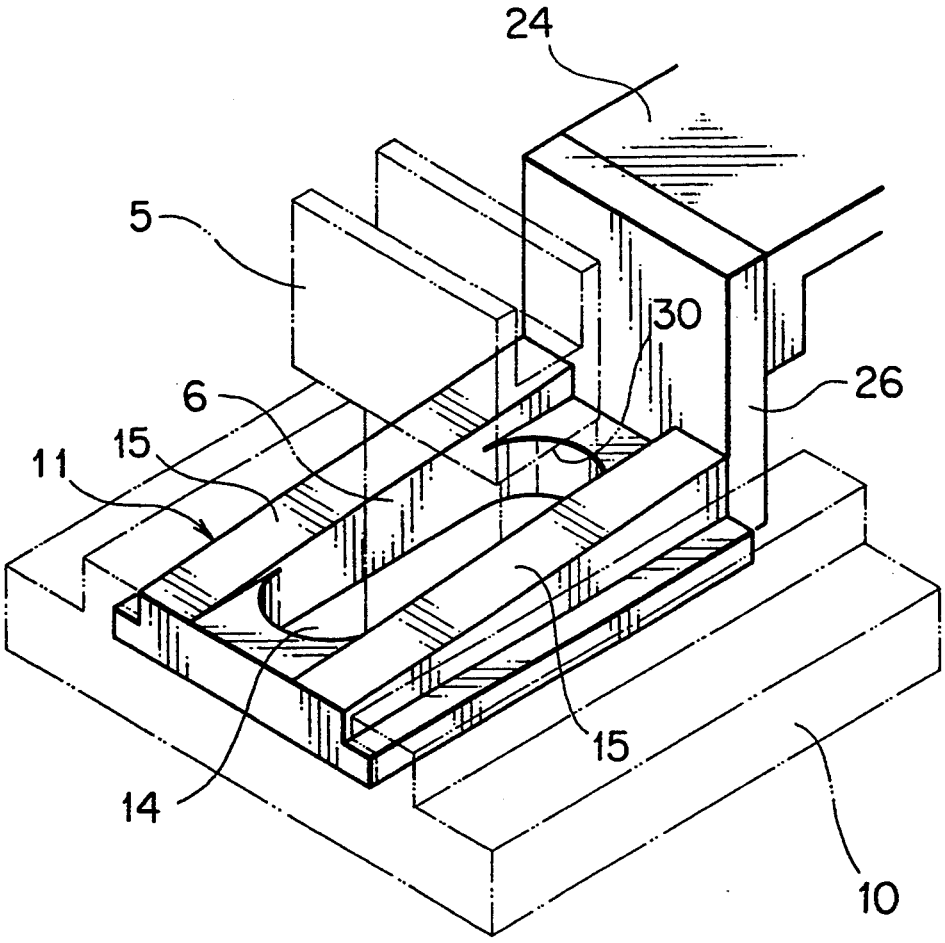
FIG. 5 is a perspective view of a height adjusting plate and a bumping member in the embodiment in FIG. 1.

FIGS. 3 and 4 shows the state of the upper dead point of the cylinder 4. In this state, the applicator 9 is mounted as indicated in two-dot chain lines in FIGS. 1 and 2. The applicator 9 is composed of a sliding portion 33 having an upper crimper 32, a frame portion 35 having a lower anvil 34 for the crimper 32 to guide the sliding portion 33 and a terminal feeding mechanism (not shown). The applicator is replaced by another applicator in accordance with the kind of the terminal 36.

Figure 6:
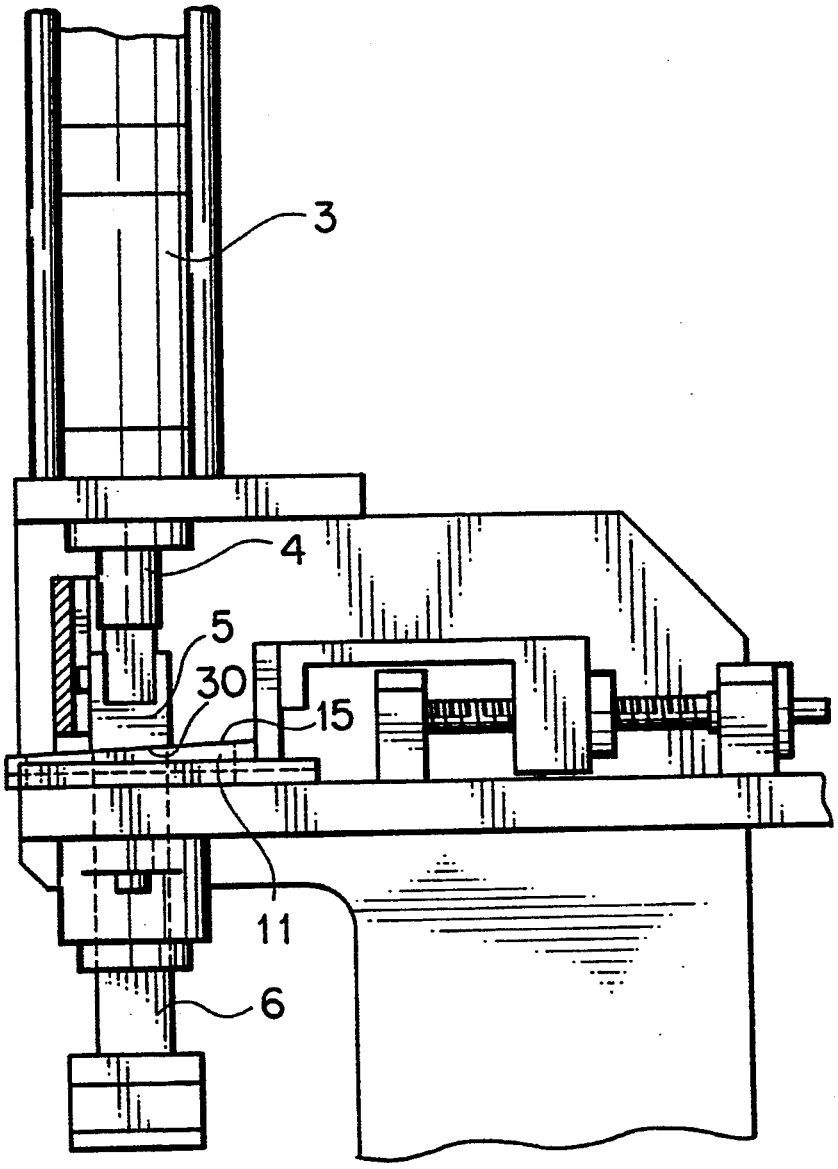
FIG. 6 is a main-part-enlarged side view with at the lower dead point of the crimping machine in the embodiment in FIG. 1.
Figure 7:
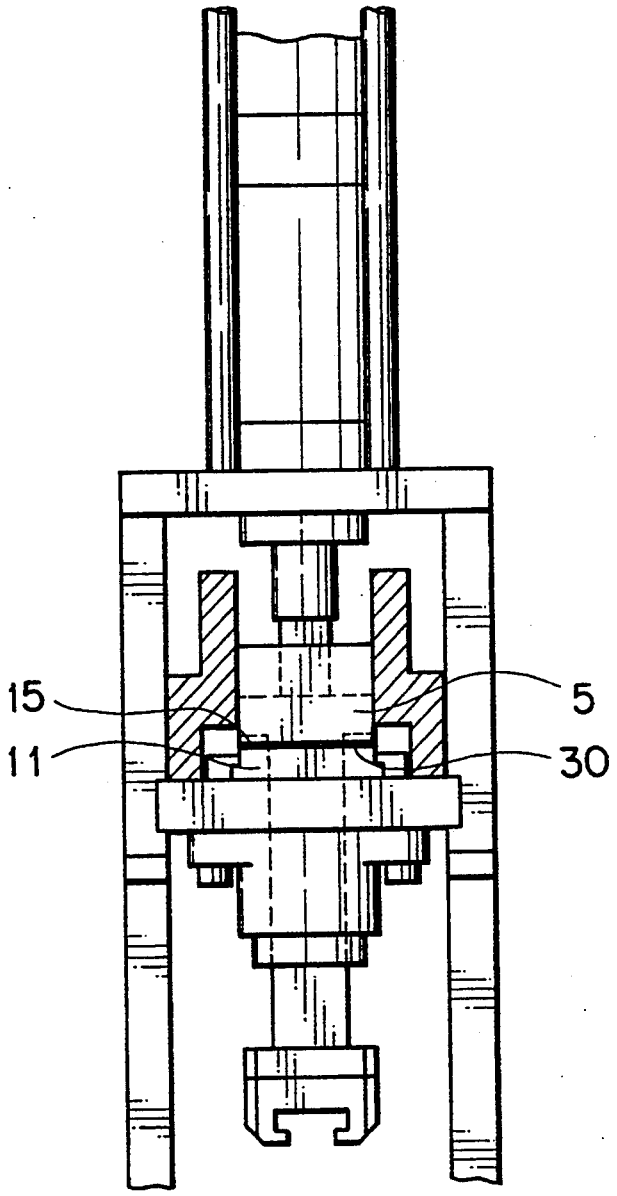
FIG. 7 is a main-part-enlarged front view with at the lower dead point of the crimping machine in the embodiment in FIG. 1.

FIGS. 6 and 7 show the state of the lower dead point where the cylinder rod 36 moves downward so that the applicator 9 completes crimping of the terminal 36 to the wire 37. The lower dead point can be obtained by colliding or mating the downward tapered slope of the bumping member 5 with the upward adjusting plate 11. Adjustment of the crimping height or shifting of the height adjusting plate 11 can be done, even while the machine is operated, regardless of replacement of the applicator 9 at the upper dead point.

Figure 8:
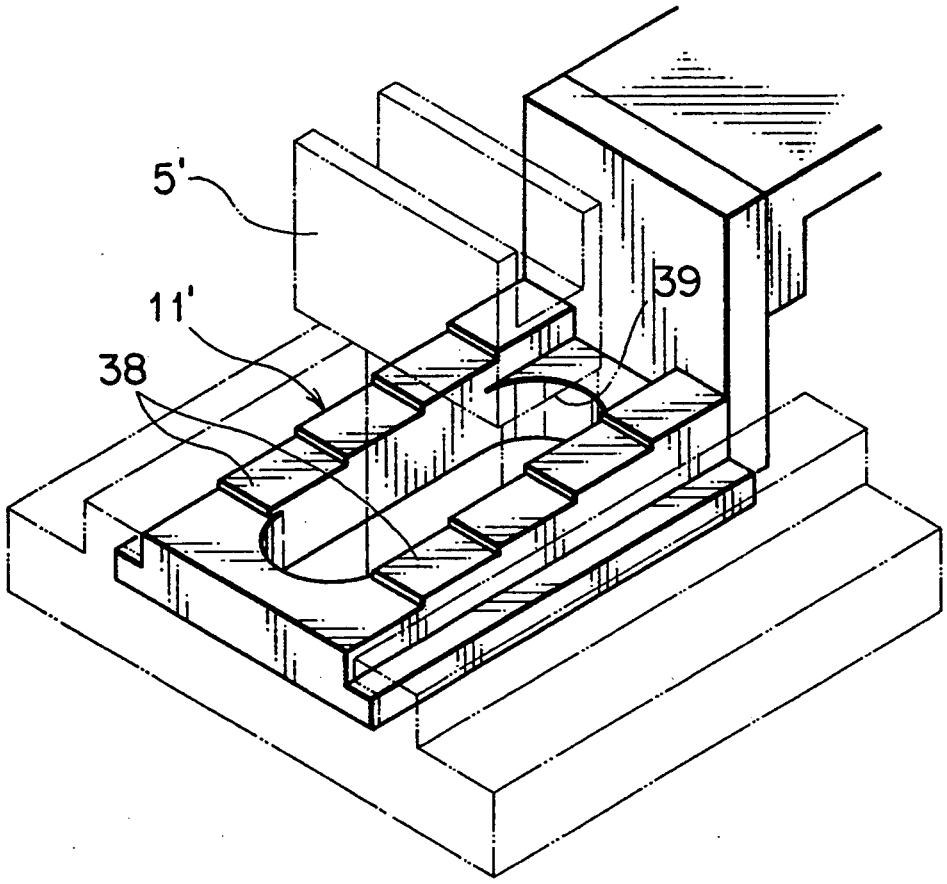
FIG. 8 is a perspective view of another example of the height adjusting plate and a bumping member.

Incidentally, as shown in FIG. 8, in place of the height adjusting plate 11 for stepless adjustment, another height adjusting plate 11′ for stepping adjustment is used which has a stepped upward horizontal surface 38 but not the upward tapered slope 15 as a face having a gradually changing height. In this case, the bumping member 5′ has a downward horizontal surface 39 but not the downward tapered slope 30.

Embodiment 2

Figure 9:
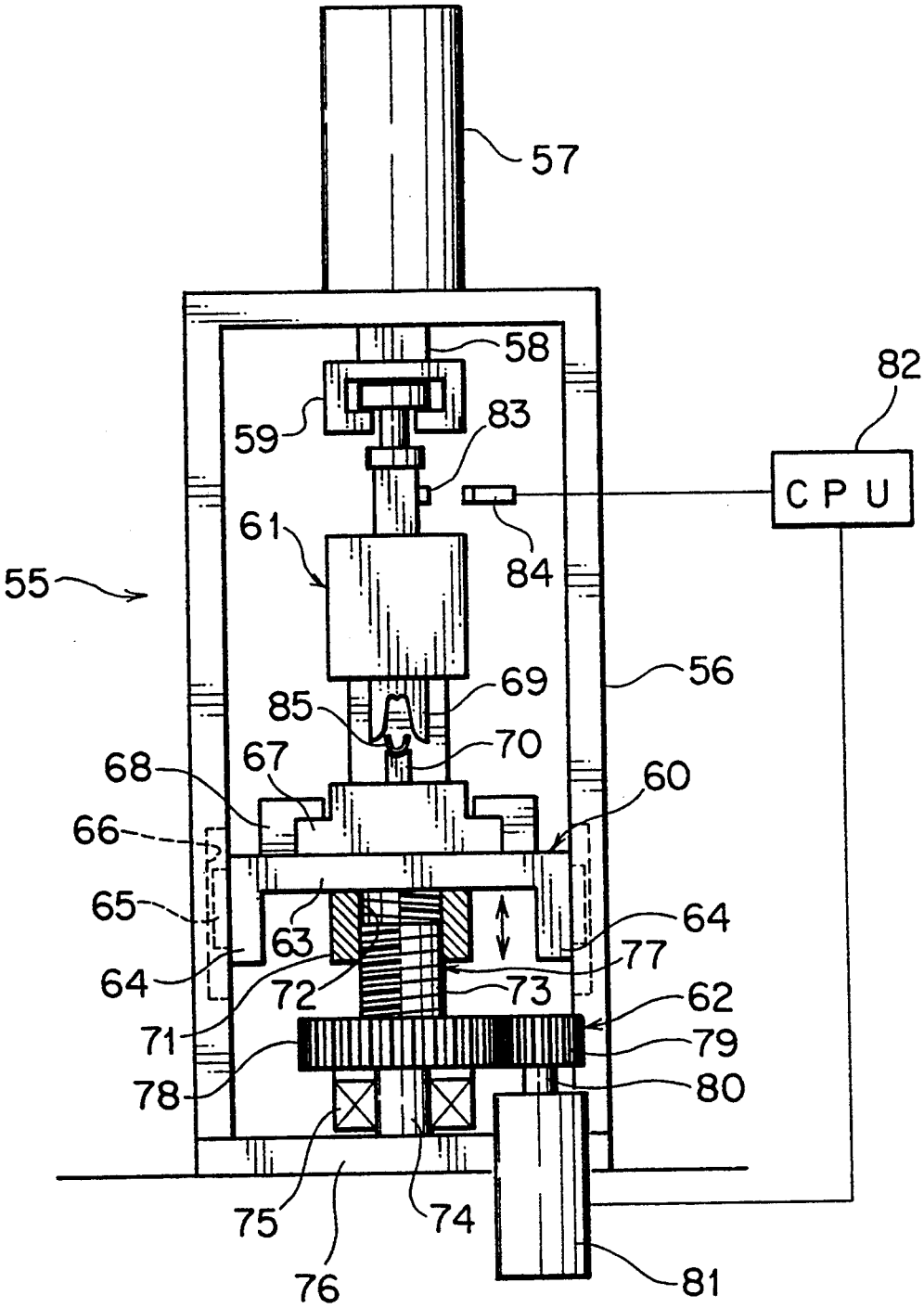
FIG. 9 is a partially-cut front view showing the second embodiment of the terminal crimping machine according to the present invention.
Figure 10:
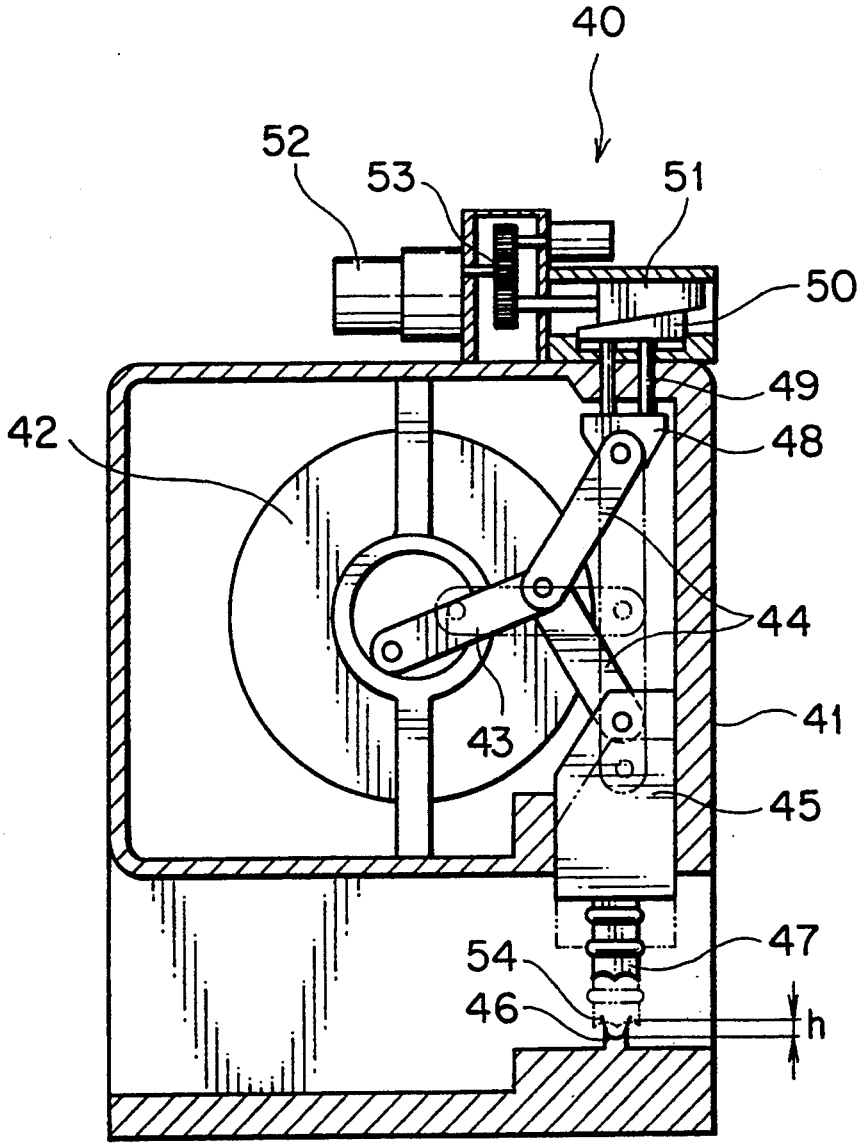
FIG. 10 PRIOR ART
FIG. 10 is a longitudinal sectional view of the prior art.

FIG. 9 is a front view of the second embodiment of the terminal crimping machine according to the present invention.

In this embodiment, a terminal crimping machine 55 is composed of a power cylinder 57 fixed to the upper portion of a frame 56, a junk holder 59 fixed to the tip of the rod 58 of the cylinder 57, a frame stand 60 attached to the lower portion of the frame 56 so that it can rise or fall, an applicator 60 mounted between the junk holder 59 and the frame stand 60, and a driving device 62 which moves the frame stand 60 up and down.

The frame stand 60 is composed of a base portion 63 and side plates 64, 64 integral to it on both sides. The frame stand 60 is adapted to be slidable up and down in such a manner that the engagement portion 65 protrusively provided on each side plate 64 is engaged with the guiding portion 66 of the frame 56. The base portion 63 is provided with "L" shape guiding plates 68 for the bottom wall 67 of the applicator 61. The applicator 61 is adapted to be removable in the sliding system in a transversal direction together with the junk holder 59. The applicator 61 has an upper crimper 69 which rises or falls by the cylinder 57 as in the previous embodiment and a lower anvil 70 protruding from the bottom wall 67.

The driving device 62 is arranged on the lower side of the frame stand 60. The driving device 62 is composed of a hollow-ring female screw 71 fixed to the bottom side of the frame stand 60, a male screw member 77 which is composed of a male screw portion 73 on its tip side screwed on the female screw portion 72 of the female screw member 71 and a shaft portion 74 on its base side pivoted on a frame bottom wall 76 through a bearing 75, a deceleration gear 78 formed integrally at the intermediate portion of the male screw member 77, a pinion gear 79 to be engaged with the deceleration gear 78, and a motor 81 with the pinion gear 79 fixed on a rotary shaft 80.

As in the previous embodiment, the motor 81 is connected with a control device 82. The control device 82 is connected to a sensor 84 provided oppositely to the discrimination protrusion 83 of the applicator 61 so that the crimping height according to the applicator 61 is automatically adjusted. In this state, when it is intended that the crimping height is adjusted in accordance with the kind of the terminal 85, the driving device 62 is driven by the operation of a rise/fall button (not shown). Specifically, the deceleration gear 78 is rotated through the pinion 79 by the rotation of the motor 81, and the male screw member 77 which rotates simultaneously with the deceleration gear 78 causes the screwed female member 71 to fall or rise at a minute speed within the frame 56. Thus, a desired crimping height can be obtained with no step and simply.

We claim:

1. A terminal crimping machine provided with an applicator having a crimper for crimping a terminal to a wire and an anvil, said terminal crimping machine comprising:

a frame;

a cylinder being fixed to said frame and having a rod, wherein said cylinder moves the crimper up and down;

a bumping member fixed on the rod of said cylinder, said bumping member having a contact surface;

a height adjusting plate, having a side of a gradually changing height, provided on said frame oppositely to said bumping member, said side of a gradually changing height directly contacting said contact surface of said bumping member; and driving means for sliding said height adjusting plate in a direction orthogonal to said rod.

2. A terminal crimping machine according to claim 1, wherein said applicator has a discrimination protrusion representative of its kind.

3. A terminal crimping machine according to claim 2, further comprising a discrimination sensor provided oppositely to said discrimination protrusion, for sensing it to discriminate the kind of said applicator; and a control device connected between said discrimination sensor and said driving device for storing crimping heights for said applicator.

4. A terminal crimping machine according to claim 1, wherein said height adjusting plate has an upward tapered slope and said bumping member has a downward tapered slope to be mated with the upward tapered slope.

5. A terminal crimping machine according to claim 1, wherein said height adjusting plate has upward stepped horizontal surfaces and said bumping member has a downward horizontal surface.

* * * * *